United States Patent [19]

Settineri et al.

[11] 4,363,673

[45] Dec. 14, 1982

[54] PROCESS FOR THE REMOVAL OF CARBON FROM SOLID SURFACES

[75] Inventors: William J. Settineri; Harold E. Klassen, both of Midland; Milton C. Tolly, Hope, all of Mich.

[73] Assignee: The Dow Chemical Company, Midland, Mich.

[21] Appl. No.: 266,557

[22] Filed: May 22, 1981

[51] Int. Cl.[3] ..... B08B 7/00

[52] U.S. Cl. ..... 134/2; 134/26; 134/31; 134/39; 134/40

[58] Field of Search ..... 134/2, 3, 20, 26, 31, 134/39, 40; 148/16, 18; 252/95, 100, 104

[56] References Cited

U.S. PATENT DOCUMENTS

| | | | |
|---|---|---|---|
| 1,310,985 | 7/1919 | Ellis et al. | 252/104 X |
| 1,445,329 | 2/1923 | Lenher | 134/39 X |
| 2,347,527 | 4/1944 | Vanderbilt | 134/39 X |
| 2,626,225 | 1/1953 | Brandes et al. | 134/20 |
| 3,962,108 | 6/1976 | Perruccio | 134/38 X |
| 3,973,998 | 8/1976 | Datta et al. | 148/6.14 R |
| 4,108,681 | 8/1978 | Lawson et al. | 134/20 |
| 4,242,218 | 12/1980 | Mey | 134/38 X |

OTHER PUBLICATIONS

*Chem. Abstracts,* "Abstract No. 40,330e", vol. 94, 1981, p. 666.

*Comprehensive Inorg. Chem.,* vol. 2, 1973, p. 868.

*Primary Examiner*—Marc L. Caroff

*Attorney, Agent, or Firm*—Stephen S. Grace

[57] ABSTRACT

A method of removing residual carbon from solid surfaces, such as metal or glass, by contacting the surface with sulfur trioxide and thereafter rinsing the surface. The surface may be subsequently contacted with a passivating solution.

10 Claims, No Drawings

PROCESS FOR THE REMOVAL OF CARBON FROM SOLID SURFACES

BACKGROUND OF THE INVENTION

Due to prior processing, surfaces of solid materials, such as metal or glass, may have thereon a layer of residual carbon in various forms. Such surface carbon can interfere with subsequent treatment of the surface. For example, steel plate or sheet has residual organic compounds on the surfaces thereof which come from lubricants used in rolling the metal. The carbon is particularly difficult to remove after the steel has been annealed. When the steel is later treated, e.g., phosphatized or painted, the residual carbon on the surface of the steel can interfere with effective treatment, thereby increasing the potential for corrosion of the steel in subsequent applications. In the past, acid or alkaline washes have been used in an effort to clean the metal surface and remove residual carbon.

THE INVENTION

The present invention provides for a method of treating metal, glass or other surfaces that have thereon a layer of residual carbon. The process comprises contacting such solid surface with a sulfur trioxide-containing fluid, preferably under essentially anhydrous conditions, and rinsing the so-treated surface. By such treatment, the carbon layer is effectively removed.

The carbon is present in the form of various organic compounds or inert, zero valence carbon (amorphous or graphitic). The organic compounds may come from greases or oils left on the surface from prior processing. The inert carbon is generated from decomposition of the organic compounds as a result of heat treatment of the solid surface. On a metal surface, the carbon layer can be incorporated into the irregular surface to a depth of, for example, 50Å.

The sulfur trioxide-containing fluid employed can be gaseous sulfur trioxide alone or as the active component in a fluid system (gas or liquid). The fluid should be one which conveys the sulfur trioxide to the surface to be cleaned in such a form to permit the sulfur trioxide to function in the present process. Preferably the fluid is substantially non-reactive with the sulfur trioxide. Examples of the fluid system include dry air, nitrogen and chlorinated solvents.

Preferably, contact of the solid surface with the sulfur trioxide containing fluid should be accomplished under essentially water-free conditions. If the solid surface is wet, the surface can be first dried, for example, by heating to elevated temperatures, to remove residual surface moisture. Preferably, the atmosphere around the contact area between the solid surface and sulfur trioxide-containing fluid should be essentially anhydrous. For example, if the contact is to be made in a container, the atmosphere within the container can be purged to reduce water vapor prior to contact of the sulfur trioxide gas with the solid surface.

The contact time utilized in the method of the present invention is dependent upon the desired amount of carbon layer to be removed and the concentration of the sulfur trioxide in the fluid. In general, the higher the concentration of the sulfur trioxide, the shorter amount of time required to remove a given amount of surface carbon. Experiments indicate that most of the carbon is removed by the process even with only a few seconds of contact.

After the surface has been contacted with the sulfur trioxide, it is flushed, swept or otherwise rinsed with a fluid (gas or liquid). Preferably, the rinse fluid is a water based liquid. The rinsing step can also be the first step in post treatment processing of the surface.

If the solid to be cleaned is steel or steel alloy, it has been observed that the metal surface after contact with the sulfur trioxide containing fluid is highly activated, for example as shown by rapid formation of red rust on steel surfaces. Therefore, preferably in the method of the present invention the steel surface treated with sulfur trioxide fluid should be subsequently contacted with a passivating solution. A passivating solution is one which prevents or otherwise inhibits oxidation of the metal surface, thus stabilizing the surface. The passivating solution can for example be made up of any known metal surface complexing agents, e.g., chelating agents such as ethylenediaminetetraacetic acid or hydroxyethylimidoiacetate, nitrites, nitrates and chromates which effectively passivate the treated surface. The passivating solution can also serve as the fluid in the rinsing step. Preferably, a water wash is employed immediately after the contact with the passivating solution.

Although preferred for most applications, passivating the steel surface is not required to obtain utility of the present invention. It is desirable, for example, in phosphatizing steel to have a clean, chemically homogeneous, active surface on which to carry out the phosphating. The method of the present invention provides such a steel surface.

The present method is applicable to a variety of solid surfaces which have a residual carbon layer which is desired to be removed, including metals, and ceramics such as glass. The present method provides a rapid, inexpensive, simple procedure for effective removal of residual surface carbon. The process can be carried out in a batch operation or preferably in a continuous line operation where the solid surface is passed through a zone of sulfur trioxide-containing fluid.

In another aspect of the present invention, there is provided an article of manufacture having a solid surface with reduced residual carbon thereon which has been treated in accordance with the method of the present invention. Preferably, such article of manufacture has been further contacted with a passivating solution to provide for a substantially stable surface with reduced residual carbon.

EXAMPLES

The examples described herein unless otherwise specified were conducted utilizing the following equipment. To provide a sulfur trioxide gas for contact with the solid surface, a sulfur trioxide vaporizer in a steam-heated bath was employed. Such vaporizer was connected to a four-liter stainless steel/glass treatment chamber into which samples of solids were placed to be treated. By heating the sulfur trioxide vaporizer and opening connecting lines into the four-liter chamber, $SO_3$ vapors were transferred into the treatment chamber. Passivating solutions or water rinses were fed directly into the treatment chamber.

In all the examples, surface carbon was measured by Auger electron spectroscopy. The Auger spectroscopy method is well known in the art. A summary can be found in the publication "Methods and Phenomena, Methods of Surface Analysis", Vol. 1, Chapter 5, Elsevier Scientific Publishing Company (1975). In addition, it was observed on all metal samples which were treated in accordance with the present invention that the surfaces of such treated metal samples were easily wet with water. A drop of water on such surface would quickly form a film; a characteristic of a substantially clean metal surface.

EXAMPLES 1-5

Aluminum foil samples were placed in the treatment chamber and, after a nitrogen flush, about 5.4 grams of $SO_3$ was vaporized into the chamber. After specified contact time, water was quickly flowed into the chamber to dissolve the $SO_3$ and rinse the coupons. Results of multiple Auger spectroscopy determinations are given in Table I.

TABLE I

Auger Surface Analysis (Weight % Carbon) For $SO_3$ Treated Al Samples

| Example | Time of Contact (seconds) | Average Weight % Carbon (3 determinations) |
|---|---|---|
| Comparative | 0 | 73 |
| 1 | 30 | 4 |
| 2 | 60 | 5 |
| 3 | 120 | 5 |
| 4 | 180 | 8 |
| 5 | 240 | 5 |

These examples demonstrate the effective removal of surface carbon by the present method.

EXAMPLE 6

Cold rolled steel panels were allowed to equilibrate to 60° C. in the treatment chamber. After nitrogen flushing of the chamber and evacuation, 2 milliliters of liquid $SO_3$ were vaporized into the chamber. The $SO_3$ was held in contact with the warm coupons for 20 minutes before flushing out the $SO_3$ vapors with nitrogen and rinsing the coupons with deionized water. These were dried and submitted for Auger spectroscopy. An untreated control panel was also examined for comparison with the treated sample. Review of the resulting Auger depth profiles indicated a reduction in surface carbon from about 25 weight percent to less than 2 weight percent.

EXAMPLES 7-9

Mild steel coupons (2.5 cm × 7 cm × 3 mm thick) were toluene washed, rinsed in acetone, and pickled in 10% HCl for 10 minutes. These were dried and suspended in the treatment chamber. The chamber was nitrogen flushed and 10.8 grams of $SO_3$ vaporized into the four liter volume. Contact time with the $SO_3$ vapors was 10 minutes before the $SO_3$ was blown out with a nitrogen stream. Three coupons were treated in each sulfonation and each batch of three coupons was placed directly into different rinses.

The three rinses were (Example 7) deionized water, (Example 8) 0.01 N NaOH, (Example 9) a 5% solution of hydroxyethylimidodiacetate (HEIDA). Coupons were stirred in the rinse solution for 10 minutes.

In the case of the deionized water rinse, the coupon surface began to discolor while still in the rinse. It turned black and when out of the rinse began to form red rust.

No initial coupon discoloration was observed in the 0.01 N NaOH and 5% HEIDA solutions. All coupons were removed from their rinse solutions and given a 5-minute fresh deionized water rinse and hung up to air dry. The coupons rinsed in the 0.01 N NaOH rusted only slightly while the three coupons from the HEIDA bath remained clean, rust free and shiny.

Auger spectroscopy measurements were made on the mild steel coupons following the rinsing step. The results are given in Table II.

TABLE II

Auger Spectroscopy Measurements For $SO_3$ Cleaned and Rinsed Coupons

| Example No. | Coupon Treatment | Weight % Carbon |
|---|---|---|
| 7 | Deionized water rinse for 10 minutes after $SO_3$ | 1.1 |
| 8 | 0.01 N NaOH rinse for 10 minutes after $SO_3$ | 2.3 |
| 9 | 5% HEIDA rinse for 10 minutes after $SO_3$ | 3.6 |
| Comparative | No treatment | 29.0 |

EXAMPLES 10-14

$SO_3$ treatment of steel metal samples (3″×4″) was done in the treatment chamber. Samples to be treated were hung in the sealed off volume of the chamber, the chamber evacuated to 2-3 millimeters of mercury pressure, about 4 grams of $SO_3$ vaporized into the vacuum and held in contact with the coupons for 5 minutes, and finally a rinse applied directly into the container still containing the steel and residual $SO_3$ vapor. The rinse contained a chelant in varying amounts. Enough NaOH was added to the rinse in each case to neutralize the sulfuric acid formed when the rinse mixed with residual $SO_3$. After a 1-minute contact with this rinse, the coupons were removed, rinsed in deionized water and air dried.

The results of the Auger spectroscopy analysis of the cleaned surfaces together with other experimental observations are presented in Table III.

TABLE III

| Example | Rinse Description | Sample Observations | Surface Weight % of Carbon by Auger Analysis |
|---|---|---|---|
| Comparative** | No $SO_3$ or rinse | — | 40-60 |
| 10A* | Deionized (DI) water | Immediate red rusting | 14 |
| 10B** | rinse - no chelant | (fine and uniform) on air drying after rinse | 15 |
| 11A | 1% HEIDA*** in DI | Still red rust, not as | 18 |
| 11B | water | heavy as above | 30 |
| 12A | 1% HEIDA plus 2 | Good looking coupon | 18 |
| 12B | grams of NaOH in 4 liters of DI water | surface, very little red rust forming on drying away final rinse | 19 |
| 13A | Rinse as above but | Same as above - | 20 |

TABLE III-continued

| Example | Rinse Description | Sample Observations | Surface Weight % of Carbon by Auger Analysis |
|---|---|---|---|
| 13B | increased HEIDA to 3% level | especially chrome - chrome oxide panels looked best | 25 |
| 14A | 5% HEIDA in water, no caustic | Quite a bit of dark streaking but no observation of red rust on drying | 22 |
| 14B | | | 16 |

*A - Cold rolled steel sheet
**B - Chrome - Chrome oxide coated steel sheet
***HEIDA is

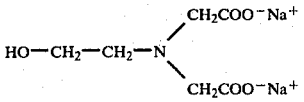

EXAMPLE 15

Small sections (3"×1"×1/32") of sheet steel exemplary of autobody steel were cut and placed in a two liter glass vessel. This chamber was flushed with nitrogen and evacuated at 60° C. 2 Milliliters of liquid $SO_3$ were injected into the chamber. Steel samples and $SO_3$ were held in contact for 20 minutes before flushing $SO_3$ vapor from treatment chamber and rinsing with deionized water. Steel samples were further rinsed in fresh deionized water and nitrogen dried. Auger analysis is presented in Table IV.

TABLE IV

| Steel Sheet - $SO_3$ Vapor Cleaned - Surface Concentration of Carbon | |
|---|---|
| Example No. | Carbon (wt. %) |
| Comparative | 44 |
| 15 | 2 |

EXAMPLES 16-20

One inch square coupons were cut from mild steel sheet typical of automobile steel. A glass bottle treatment chamber was employed which could be instantly flushed with a large volume of nitrogen. A rubber top held on by pressure (vacuum to atmosphere) could also be instantly removed. With such nitrogen flushing and quick top removal, the $SO_3$-steel contact time could be varied down as low as 10 seconds. All treatments were done after sample and treatment chamber had equilibrated to 60° C. Liquid $SO_3$ was injected directly into the treatment chamber and allowed to vaporize from the warm base of the chamber. Heat was supplied by a heated plate directly under and touching the chamber surface. The samples were removed from the chamber and rinsed with deionized water.

Table V shows that samples treated for periods of 10 seconds to 20 minutes experienced similar levels of carbon removal. These data indicate a relatively brief $SO_3$ exposure is effective in removing the surface carbon.

TABLE V

| Auger Electron Spectroscopy Surface Carbon on Sheet Steel | | |
|---|---|---|
| Example No. | Treatment | Surface Wt. % Carbon |
| 16 | 20 min. in $SO_3$ | 12 |

TABLE V-continued

| Auger Electron Spectroscopy Surface Carbon on Sheet Steel | | |
|---|---|---|
| Example No. | Treatment | Surface Wt. % Carbon |
| 17 | 10 min. in $SO_3$ | 10 |
| 18 | 1 min. in $SO_3$ | 6.4 |
| 19 | 30 sec. in $SO_3$ | 11 |
| 20 | 10 sec. in $SO_3$ | 13 |
| Comparative | No treatment | 44 |

EXAMPLE 21

Black plate steel samples (8"×3⅜"×0.006") were treated by placing them in a 3.5 liter chamber, drying the chamber with a nitrogen flush, evacuating the chamber and injecting 4 ml of liquid $SO_3$ into the chamber held at 45° C. Contact time was 5 minutes followed by a deionized water rinse. Weight percent surface carbon was reduced from 85% to 5% as measured by Auger spectroscopy.

EXAMPLES 22-23

Black plate steel samples (1"×3⅜"×0.006") were treated two at a time in a 3.5 liter chamber (steam heated) which was dried and evacuated for each treatment. Samples under vacuum were allowed to equilibrate in the chamber at 50° C. before injecting 4 ml (7.2 grams) of liquid $SO_3$ directly into the chamber. At contact times of 10 seconds and 1 minute, a nitrogen flush was used to removed and dilute $SO_3$ vapors. Samples were rinsed in deionized water and dried before Auger analysis. The analysis is given in Table VI (average of 6 samples for Examples 22-23 and average of two samples for the Comparative).

TABLE VI

| Carbon Weight % for $SO_3$ Treated Black Plate Steel | |
|---|---|
| Example No. | Carbon Weight % |
| Comparative | 65 |
| 22 (10 second treatment) | 10 |
| 23 (1 minute treatment) | 8.5 |

EXAMPLE 24

Glass samples about ¼ inch square were contacted with sulfur trioxide by injecting 2 milliliters of $SO_3$ liquid into a glass flask containing the samples. After 10 minutes of contact with vaporized $SO_3$, the flask was flushed with nitrogen, the glass samples rinsed with water and air dried. Surface carbon was analyzed by Auger spectroscopy.

Weight percent C on the surface of the treated glass samples was 10%. Weight percent C on the surface of untreated glass samples was 40%.

EXAMPLES 24–25

In these examples, the sulfur trioxide was dissolved in a chlorinated solvent. Samples of cold rolled steel sheet were subjected to the treatments described in Table VII and then measured for surface carbon. The data demonstrate the improved carbon removal accomplished by the method of the present invention.

TABLE VII $SO_3$ in Chlorinated Solvent - Cold Rolled Steel

| Example No. | Treatment | Weight % Carbon |
|---|---|---|
| Comparative | None | 97 |
| Comparative | Dipped and swirled in distilled methylene chloride for 2 minutes at room temperature | 50 |
| 24 | Dipped and swirled in solution of 10 weight % $SO_3$ in distilled methylene chloride for 2 minutes at room temperature. Samples were rinsed with deionized water. | 42 |
| 25 | Dipped and swirled in solution of 10 weight % $SO_3$ in 1,1,2,2-perchloroethylene for 2 minutes at room temperature. Samples were rinsed with deionized water. | 25 |
| 26 | Contacted with $SO_3$ gas for 2 minutes. Samples were rinsed with deionized water. | 15 |

What is claimed is:

1. A process for removing a carbon layer from a solid surface having such layer thereon which comprises contacting the surface with a gaseous fluid consisting essentially of sulfur trioxide and thereafter, rinsing the surface.

2. The process of claim 1 wherein the contacting step is carried out under essentially anhydrous conditions.

3. The process of claim 1 wherein the rinsing step is accomplished by washing the surface with water.

4. The process of claim 1 wherein the rinsing step is accomplished by contacting the surface with a passivating solution.

5. The process of claim 1 including the additional step of contacting the so-treated surface with a passivating solution.

6. The process of claim 5 wherein the passivating solution contains a chelating agent.

7. The process of claim 1 or 5 wherein the surface is a metal.

8. The process of claim 1 or 5 wherein the surface is ceramic.

9. The process of claim 1 wherein the fluid is substantially non-reactive with the sulfur trioxide.

10. The process of claim 1 wherein the fluid is gaseous sulfur trioxide.

* * * * *